US007662759B1

(12) United States Patent
Tucker et al.

(10) Patent No.: US 7,662,759 B1
(45) Date of Patent: Feb. 16, 2010

(54) DECONTAMINATION FORMULATION WITH ADDITIVE FOR ENHANCED MOLD REMEDIATION

(75) Inventors: Mark D. Tucker, Albuquerque, NM (US); Kevin Irvine, Huntsville, AL (US); Paul Berger, Rome, NY (US); Robert Comstock, Bel Air, MD (US)

(73) Assignee: Sandia Corporation, Albuquerque, NM (US)

( * ) Notice: Subject to any disclaimer, the term of this patent is extended or adjusted under 35 U.S.C. 154(b) by 675 days.

(21) Appl. No.: 11/341,920

(22) Filed: Jan. 27, 2006

Related U.S. Application Data

(60) Provisional application No. 60/647,988, filed on Jan. 28, 2005.

(51) Int. Cl.

| | |
|---|---|
| ***A62D 3/00*** | (2007.01) |
| ***B01F 17/18*** | (2006.01) |
| ***B01F 17/38*** | (2006.01) |
| ***C11D 1/62*** | (2006.01) |
| ***C11D 3/39*** | (2006.01) |

(52) U.S. Cl. ..... 510/110; 510/372; 510/504; 588/315; 588/320; 588/400; 588/401; 588/406; 588/408; 588/409; 588/901; 252/186.38; 252/186.39; 252/186.41; 252/186.42

(58) Field of Classification Search ..... 510/110; 252/186.38; 588/315, 400
See application file for complete search history.

(56) References Cited

U.S. PATENT DOCUMENTS

| | | | | | |
|---|---|---|---|---|---|
| 3,852,210 | A * | 12/1974 | Krezanoski | ..... | 510/372 |
| 3,901,819 | A * | 8/1975 | Nakagawa et al. | ..... | 252/186.4 |
| 4,536,314 | A * | 8/1985 | Hardy et al. | ..... | 510/376 |
| 4,693,833 | A * | 9/1987 | Toshikuni et al. | ..... | 210/759 |
| 4,853,143 | A * | 8/1989 | Hardy et al. | ..... | 510/312 |
| 5,116,575 | A * | 5/1992 | Badertscher et al. | ..... | 422/28 |
| 5,232,484 | A * | 8/1993 | Pignatello | ..... | 558/206 |
| 5,460,792 | A * | 10/1995 | Rosenbaum | ..... | 423/245.3 |
| 5,769,089 | A * | 6/1998 | Hand et al. | ..... | 128/858 |
| 5,855,797 | A * | 1/1999 | Luong et al. | ..... | 405/128.5 |
| 5,859,064 | A * | 1/1999 | Cronce | ..... | 514/643 |
| 6,160,194 | A * | 12/2000 | Pignatello | ..... | 405/128.5 |
| 6,211,129 | B1 * | 4/2001 | Gladfelter et al. | ..... | 510/294 |
| 6,268,205 | B1 * | 7/2001 | Kiest et al. | ..... | 435/262.5 |
| 6,566,574 | B1 * | 5/2003 | Tadros et al. | ..... | 252/186.41 |
| 6,723,890 | B2 * | 4/2004 | Tucker et al. | ..... | 588/318 |
| 7,125,497 | B1 * | 10/2006 | Tucker et al. | ..... | 252/188.21 |
| 7,271,137 | B2 * | 9/2007 | Tucker et al. | ..... | 510/110 |
| 7,276,468 | B1 * | 10/2007 | Tucker | ..... | 510/110 |
| 7,282,470 | B2 * | 10/2007 | Tucker et al. | ..... | 510/110 |
| 7,390,432 | B2 * | 6/2008 | Tucker | ..... | 252/186.41 |
| 2002/0110509 | A1 * | 8/2002 | Lundy | ..... | 423/143 |
| 2002/0143226 | A1 * | 10/2002 | Saha et al. | ..... | 588/205 |
| 2003/0060517 | A1 * | 3/2003 | Tucker et al. | ..... | 516/38 |
| 2003/0158459 | A1 * | 8/2003 | Tucker | ..... | 588/200 |
| 2004/0022867 | A1 * | 2/2004 | Tucker et al. | ..... | 424/616 |

* cited by examiner

*Primary Examiner*—Joseph D Anthony
(74) *Attorney, Agent, or Firm*—Robert D. Watson

(57) ABSTRACT

Decontamination formulations with an additive for enhancing mold remediation. The formulations include a solubilizing agent (e.g., a cationic surfactant), a reactive compound (e.g., hydrogen peroxide), a carbonate or bicarbonate salt, a water-soluble bleaching activator (e.g., propylene glycol diacetate or glycerol diacetate), a mold remediation enhancer containing Fe or Mn, and water. The concentration of $Fe^{2+}$ or $Mn^{2+}$ ions in the aqueous mixture is in the range of about 0.0001% to about 0.001%. The enhanced formulations can be delivered, for example, as a foam, spray, liquid, fog, mist, or aerosol for neutralization of chemical compounds, and for killing certain biological compounds or agents and mold spores, on contaminated surfaces and materials.

13 Claims, No Drawings

DECONTAMINATION FORMULATION WITH ADDITIVE FOR ENHANCED MOLD REMEDIATION

CROSS-REFERENCE TO RELATED APPLICATIONS

This application claims the benefit of U.S. Provisional Patent Application Ser. No. 60/647,988, filed Jan. 28, 2005, and the specification thereof is incorporated herein by reference.

GOVERNMENT RIGHTS

The Government has rights to this invention pursuant to Contract No. DE-AC04-94AL85000 awarded by the U.S. Department of Energy.

BACKGROUND OF THE INVENTION

The present invention relates to formulations for neutralization of chemical, biological and industrial toxants; for mold remediation; and to methods of making same. In particular, the present invention is directed to decontamination formulations comprising a solubilizing compound, a reactive compound, a bleaching activator, a mold remediation enhancer, and water; that can be delivered, for example, as a foam, spray, liquid, fog, mist, or aerosol for neutralization of chemical compounds, and for killing certain biological compounds or agents and mold spores, on contaminated surfaces and materials.

Sandia National Laboratory in Albuquerque, N. Mex., has developed a family of decontamination formulations called "DF-200." DF-200 formulations comprise a solubilizing compound, a reactive compound, a bleaching activator, and water. Related decontamination formulations developed by Tucker et al. at Sandia Labs are described in U.S. Pat. Nos. 6,566,574 and 6,723,89.

Although DF-200 (i.e., the family of "DF-200" formulations) was developed primarily to neutralize chemical and biological warfare agents, e.g., sarin gas, VX gas, mustard gas, botulinum toxin, anthrax spores, the virus that causes SARS; and toxic industrial chemicals, e.g., malathion, butyl isocyanate, sodium cyanide, sodium disulfide, and phosgene, it can also be used for the disinfection and/or sterilization of other biological pathogens that are related to public health issues. One such application is mold remediation. Mold growth is a problem in many public and private facilities throughout the U.S. and the world. It can become a serious problem in homes and buildings, for example, in the aftermath of floods, hurricanes, tsunamis, etc. Of particular interest in mold remediation are organisms such as *Stachybotrys, Cladosporidium, Basidiospores*, and *Pennicullium* mold spores.

DF-200 formulations have been previously determined to be effective against mold-related microorganisms. EnviroFoam Technologies is a licensee of the Sandia Decon Formation (DF-200). The product manufactured by EnviroFoam Technologies, EasyDECON™-200, is based on DF-200 and has been tested against *Stachybotrys* mold spores by MICROBIOTEST, Inc. (a U.S. EPA certified laboratory located in Sterling, Va.) using the AOAC Use Dilution Test protocol.

*Stachybotrys chartarum* (*S. chartarum*) was dried on stainless steel pennicylinders and exposed to EasyDECON™-200 for 60 minutes at 20±2° C. Carrier counts were an average of $3.4\times10^4$ CFU/carrier. All of the controls met the criteria established for a valid test. Although a 60 minute contact time was designated by the test protocol, complete kill of the mold spores was exhibited within 5 to 10 minutes. There was no re-growth of *Stachybotrys* mold spores after contact with EasyDECON™-200. Results are shown below in Table 1, which shows the number of positive tests (i.e., tests where organisms survived)/total number of tests.

TABLE 1

Effect of EasyDECON ™-200 on *Stachybotrys* mold spores

| Microorganism | EasyDECON ™-200 (Batch 1) | EasyDECON ™-200 (Batch 2) |
|---|---|---|
| *S. chartarum* | 0/10 | 0/10 |

For remediating mold at an actual, contaminated site, DF-200 is used in two general application methods. First, DF-200 is applied as a liquid to areas that are visibly contaminated with high levels of mold growth. Some physical scrubbing or agitation may also be used to help DF-200 penetrate into the interior of the mold growth. Following application of liquid DF-200 to areas of heavy mold growth, the contaminated facility is then filled with a fog or mist of DF-200. This fog is typically generated by commercially-available cold fogging or thermal fogging devices in droplet sizes of 50 μm or smaller.

EnviroFoam Technologies (through various subcontractors) has recently used this method to decontaminate several mold-contaminated facilities. However, inconsistent results were observed in the fogging portion of the remediation process. Under nearly identical fogging conditions, different batches of EnviroFoam's EasyDECON™-200 yielded greatly different efficacy against mold spores of interest. Through a series of tests, it was determined that batches of EasyDECON-200 that achieved high efficacy against mold spores contain a low concentration of iron, while those batches that were less effective did not contain iron.

Against this background, the present invention was developed.

SUMMARY OF THE INVENTION

The present invention relates to decontamination formulations with an additive for enhancing mold remediation. The formulations include a solubilizing agent (e.g., a cationic surfactant), a reactive compound (e.g., hydrogen peroxide), a carbonate or bicarbonate salt, a water-soluble bleaching activator (e.g., propylene glycol diacetate or glycerol diacetate), a mold remediation enhancer containing Fe or Mn, and water. The concentration of $Fe^{2+}$ or $Mn^{2+}$ ions in the aqueous mixture is in the range of about 0.0001% to about 0.001%. The enhanced formulations can be delivered, for example, as a foam, spray, liquid, fog, mist, or aerosol for neutralization of chemical compounds, and for killing certain biological compounds or agents and mold spores, on contaminated surfaces and materials.

DETAILED DESCRIPTION OF THE INVENTION

The present invention relates to formulations for neutralization of chemical, biological and industrial toxants; for mold remediation; and to methods of making same. In particular, the present invention is directed to aqueous formulations comprising a solubilizing compound, a reactive compound, a bleaching activator, a mold remediation enhancer, and water. When mixed together, the liquid formulation can be delivered, for example, as a foam, spray, liquid, fog, mist, or aerosol for neutralization of chemical compounds, and for killing certain biological compounds or agents and mold spores, on contaminated surfaces and materials.

Neutralization is defined as the mitigation, de-toxification, decontamination, or otherwise destruction of toxants to the extent that the toxants no longer cause acute adverse effects to humans or animals. The formulation and described variations of the present invention can neutralize, and does not themselves contain or produce, infection, significant adverse health effects, or even fatality in animals.

The word "formulation" is defined herein as the activated product or solution (e.g., aqueous solution formed when all of the ingredients are mixed with water to form a "mixture") that is applied to a surface or body for the purpose of neutralization, with or without the addition of a gas (e.g., air) to create foam. Unless otherwise specifically stated, the concentrations, constituents, or components listed herein are relative to the weight percentage of the overall activated solution (i.e., the "mixture"). The word "water" is defined herein to broadly include: pure water, tap water, deionized water, demineralized water, saltwater, or any other liquid consisting essentially of $H_2O$.

For mold remediation at an actual, contaminated site, DF-200 can be used in a two-step process. First, DF-200 is applied as a liquid to areas that are visibly contaminated with high levels of mold growth. Some physical scrubbing or agitation may also be used to help DF-200 penetrate into the interior of the mold growth. Following the application of liquid DF-200 to areas of heavy mold growth, the contaminated facility is then filled with a fog or mist of DF-200. This fog is typically generated by commercially-available cold fogging or thermal fogging devices in droplet sizes of 50 μm or smaller.

EnviroFoam Technologies (through various subcontractors) has recently used this approach to decontaminate several mold-contaminated facilities. However, inconsistent results were achieved in the fogging portion (second stage) of the remediation process. Under nearly identical fogging conditions, different batches of Envirofoam EasyDECON™-200 yielded greatly different efficacy against mold spores of interest. It was discovered that DF-200 formulation that had been pumped through a rusty pump performed better than DF-200 that had not been pumped through the rusty pump. This led to discussions amongst the inventors and development of the idea that small amounts of iron (from the rusty pump) might be improving the effectiveness of the formulation against mold. Through a series of tests where low concentrations of $FeCl_2.4H_2O$ were added, this hypothesis was confirmed.

Hence, the addition of a low concentration of iron (<0.001%) was found to greatly increase the efficacy of DF-200 against mold spores when introduced into a contaminated area as a fog or mist. The increased efficacy of using D-200 enhanced with an iron additive should apply equally well to liquid DF-200 applied directly to contaminated surfaces. Greater concentrations of iron can be added to DF-200 to achieve similar enhanced efficacy, but concentrations larger than about 0.001% can cause very high levels of foaming in DF-200, making it difficult to deploy as a mist or fog. Therefore, an optimal concentration of the iron additive for fogging or misting applications should be in the range of 0.0001% to 0.001%.

It is important to note that the addition of iron has a slight detrimental effect on the ability of DF-200 to decontaminate some chemical warfare agents. Therefore, the iron additive should only be included when DF-200 is to be used against biological pathogens (primarily mold).

It is expected that the addition of manganese (in the form of $Mn^{+2}$) will exhibit similar chemistry as iron added in the form of $Fe^{+2}$. Also, it is expected that the addition of $Fe^{+2}$ in salts other than $FeCl_2$ (e.g., $FeSO_4$) will yield similar results.

A couple of tests were performed on actual mold-contaminated houses. The test results shown below in Table 2 are typical of those achieved when standard DF-200 with no added iron is used to fog a mold-contaminated facility. These results are from an actual remediation conducted at a residence in Vallejo, Calif., using a similar procedure as described below. The mold spore count analyses were performed by Environomics West of Walnut Creek, Calif.

TABLE 2

| | Mold Spore Count for DF-200 without iron additive | | | | | | | |
|---|---|---|---|---|---|---|---|---|
| | Kitchen (pre-remediation) | | Front Room (pre-remediation) | | Kitchen (post-remediation) | | Front Room (post-remediation) | |
| Mold Spore | Raw ct. | Spores/m³ | Raw ct. | Spores/m³ | Raw ct. | Spores/m³ | Raw ct. | Spores/m³ |
| *Altemia* | | | | | — | — | — | 13 |
| Amerospores | | | | | — | 187 | — | 120 |
| Ascospores | | | | | — | 40 | — | 27 |
| Basidiospores | | | | | — | 253 | — | 80 |
| *Chaetomium* | 1000+ | 1000+ | 1000+ | 1000+ | — | 400 | — | 667 |
| *Cladosporium* | 1-49 | 1-49 | 1-49 | 1-49 | — | 80 | — | 227 |
| *Penicillium/Aspergillus* types | 1000+ | 1000+ | 1000+ | 1000+ | — | 493 | — | 893 |
| *Smuts, Periconia, Myxomycetes* | | | | | — | 53 | — | 13 |
| *Stachybotrys* | 1000+ | 1000+ | 1000+ | 1000+ | — | 587 | — | 1680 |
| Unclassified Conida | | | | | — | 13 | — | 13 |
| Total Spores/m³ | — | — | — | — | | 2107 | | 3733 |

The test results shown below in Table 3 are typical of those achieved when a low concentration of iron, 0.0007%, has been added (as $FeCl_2.4H_2O$) to DF-200. The results in Table 3 are from an actual remediation of a mold-contaminated residence located in Hayward, Calif. Remediation was done under negative pressure. No "air scrubbing" was conducted. All surfaces were HEPA vacuumed. Both rooms were fogged in two rounds separated by 45 minutes. Approximately 0.5 gallons of DF-200 was used for the two rooms. One gallon was also used in the attic and crawl space. The mold spore count analyses were performed by Environmental Microbiology Laboratory, Inc. of San Bruno, Calif. As can be seen, the efficacy of DF-200 with added iron is greatly increased, as compared to the results shown in Table 2 (without iron).

TABLE 3

| | Mold Spore Count for DF-200 with iron additive (0.0007%) | | | | | | | |
|---|---|---|---|---|---|---|---|---|
| | Kitchen (pre-remediation) | | Bedroom (pre-remediation) | | Kitchen (post-remediation) | | Bedroom (post-remediation) | |
| Mold Spore | Raw ct. | Spores/m$^3$ | Raw ct. | Spores/m$^3$ | Raw ct. | Spores/m$^3$ | Raw ct. | Spores/m$^3$ |
| Acospores | 20 | 267 | 4 | 53 | | | | |
| Basidiospores | 744 | 9920 | 476 | 6350 | 36 | 480 | 36 | 480 |
| *Chaetomium* | 10 | 133 | 3 | 40 | | | | |
| *Cladosporium* | 60 | 800 | 36 | 480 | 4 | 53 | 8 | 107 |
| Other Brown | 2 | 27 | 2 | 27 | | | | |
| *Penicillium/Aspergillus* | 148 | 1970 | 228 | 3040 | 8 | 107 | 4 | 53 |
| types | | | | | | | | |
| *Smuts, Periconia,* | 3 | 40 | 4 | 53 | | | | |
| Myxomycetes | | | | | | | | |
| *Stachybotrys* | 1 | 13 | | | | | | |
| Total Spores/m$^3$ | | 13,170 | | 10,043 | | 640 | | 653 |

It is believed that the addition of iron increases the efficacy of DF-200 against mold spores by causing the production of hydroxyl radicals (a highly reactive species), which attack and kill microorganisms such as mold spores. The reaction that produces hydroxyl radicals is shown below in the first equation:

$$Fe^{2+}+H_2O_2 \leftrightarrow Fe^{3+}+.OH+OH^-$$

The second equation below details the reduction of Fe+++ to Fe++, providing a continuous low concentration of Fe++ to catalyze the formation of hydroxyl radicals that will be consumed in the decontamination process:

$$2Fe^{3+}+H_2O_2+2OH^- \rightarrow 2Fe^{2+}+2H_20+O_2$$

The decontamination formulations of the present invention are designated herein as "DF-200ME" (Mold Enhanced), for the purposes of the instant application. In one embodiment, a DF-200ME formulation may comprise a mixture of:

a) a solubilizing agent comprising a cationic surfactant;
b) a reactive compound comprising hydrogen peroxide;
c) a carbonate or bicarbonate salt;
d) a water-soluble bleaching activator comprising propylene glycol diacetate or glycerol diacetate;
e) a mold remediation enhancer comprising Fe or Mn; wherein the concentration of $Fe^{2+}$ or $Mn^{2+}$ ions in the mixture is in the range of about 0.0001% to about 0.001%; and
f) water (balance).

The solubilizing agent serves to effectively render the toxant (e.g., mold spore) susceptible to attack, while the reactive compound combines with the carbonate or bicarbonate salt to attack and neutralize the toxant. The bleaching activator and the mold remediation enhancer serve to enhance the effectiveness of the process.

Examples of suitable cationic surfactants include quaternary ammonium salts and polymeric quaternary salts. Examples of suitable quaternary ammonium salts include: cetyltrimethyl ammonium bromide, benzalkonium chloride, benzethonium chloride, cetylpyridinium chloride, alkyldimethylbenzylammonium salt, and tetrabutyl ammonium bromide. A suitable cationic surfactant is VARIQUAT 80MC™ (supplied by Degussa Goldschmidt), which is a mixture of benzyl (C12-C16) alkyldimethylammonium chlorides. At concentrations greater than about 10%, however, quaternary ammonium salts becomes significantly toxic to humans and the environment.

The reactive compound used in DF-200ME comprises hydrogen peroxide ($H_2O_2$). $H_2O_2$ can be provided in a variety of different forms, e.g., as a liquid solution of 2-8% $H_2O_2$ in water. Alternatively, it can be provided as urea hydrogen peroxide (UHP) in powder form. When mixed with water and the other ingredients of DF-200ME formulations, the concentration of hydrogen peroxide can be in the range of 1-4%. Concentrations greater than 30%, however, can be significantly corrosive.

Hydrogen peroxide combines with the carbonate or bicarbonate salt to form the highly reactive hydroperoxycarbonate species ($HCO_4^-$). Use of carbonate or bicarbonate salts can also serve to buffer the formulation to an optimum pH. Examples of suitable carbonate or bicarbonate salts include potassium bicarbonate, sodium bicarbonate, ammonium bicarbonate, ammonium hydrogen bicarbonate, lithium bicarbonate, ammonium carbonate, and potassium carbonate.

Bleaching activators are compounds that react with strongly nucleophilic hydroperoxy anions ($OOH^-$) to yield peroxygenated species, which are more efficient oxidizers than hydrogen peroxide alone.

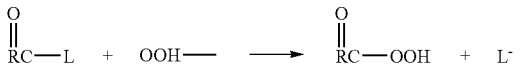

Useful water-soluble bleaching activators include short-chained organic compounds that contain an ester bond, ethylene glycol diacetate, propylene glycol monomethyl ether acetate, methyl acetate, dimethyl glutarate, diethylene glycol monoethyl ether acetate, glycerol acetate (monoacetin), glycerol diacetate (diacetin), glycerol triacetate (triacetin), acetylcholine chloride, 4-cyanobenzoic acid, propylene glycol diacetate, and combinations thereof. A preferred water-soluble bleaching activator is propylene glycol diacetate (PGDA), which is shown below.

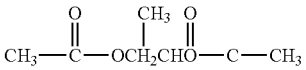

This molecule reacts with hydroperoxy anions ($OOH^-$), giving up the ester bonds to form two peroxygenated molecules. Propylene glycol diacetate also acts as an organic solvent that is highly effective in solubilizing insoluble organic molecules (e.g., chemical warfare agents, as well as foam stabilizers/boosters (such as 1-dodecanol and Lauramide DEA)). Therefore, an added function of this compound is that it can be used to supplement the di(propylene glycol) methyl ether solvent used in some DF-200 formulations, thereby allowing the propylene glycol diacetate to serve a dual purpose (i.e., solvent and bleaching activator).

Bleaching activators are generally not stable in water for long periods of time. This is especially true when the aqueous solution is at a high pH (>10). Therefore, for long shelf life, the propylene glycol diacetate (or other bleaching activator) is preferably stored separately from the aqueous solution until use. This is not unlike other products that utilize bleach activators (e.g., laundry detergents), where all the components of the formulation are kept dry and separated until use (in the case of laundry detergent, the bleaching activator is encapsulated to prevent it from reacting with the peroxide component until both components are mixed in water).

Another example of a water-soluble bleaching activator is ethylene glycol diacetate, which works well in DF-200 formulations. However, when ethylene glycol diacetate reacts with hydrogen peroxide, it forms ethylene glycol (i.e., antifreeze), which is a relatively toxic byproduct. Propylene glycol diacetate, on the other hand, does not form this relatively toxic byproduct. Another preferred water-soluble bleaching activator is glycerol diacetate.

DF-200ME formulations comprise a low concentration of a mold remediation enhancer. The enhancer comprises Fe or Mn (or both). The concentration of $Fe^{2+}$ or $Mn^{2+}$ ions in the made-up mixture can be in the range of about 0.0001% to about 0.001%; and preferably can be about 0.0007%. $Fe^{2+}$ ions may be supplied from iron-containing compounds, such as: $FeCl_2$, $Fe(OH)_2$, $FeCO_3$, $Fe_2O_4$, FeS, $FeS_2$, $FeSO_4$, $FePO_4$, $FeF_3$, $Fe(NO_3)_3$, hydrated forms of these compounds (e.g., $FeCl_2.4H_2O$), and combinations thereof. $Mn^{2+}$ ions may be supplied from manganese-containing compounds, such as: MnO, $MnCl_2$, $Mn(OH)_2$, $MnCO_3$, $Mn_3O_4$, MnS, $MnSO_4$, $Mn(CH_3COO)_2$, hydrated forms of these compounds (e.g., $MnCl_2.4H_2O$), and combinations thereof.

Optionally, some DF-200ME formulations may comprise a sufficient amount of potassium hydroxide, or other inorganic base, to adjust the pH value of the mixture to between about 9.6 and 9.9.

Optionally, some DF-200ME formulations may comprise a cationic hydrotrope. Examples of suitable cationic hydrotropes include tetrapentyl ammonium bromide, triacetyl methyl ammonium bromide, and tetrabutyl ammonium bromide. A preferred cationic hydrotrope is ADOGEN 477™ (supplied by Degussa Goldschmidt), which is a pentamethyltallow alkyltrimethylenediammonium dichloride.

Optionally, some DF-200ME formulations may comprise a fatty alcohol, a water-soluble polymer, and a solvent. Examples of suitable fatty alcohols include alcohols having 8-20 carbon atoms per molecule, such as: 1-dodecanol, pure dodecanol, hexadecanol, and 1-tetradecanol. The water-soluble polymer may comprise a cationic water-soluble polymer (e.g., Jaguar 8000™ or), which increases the bulk viscosity of the solution and produces a more stable foam. Alternatively, a non-anionic water-soluble polymer can be used, such as: polyvinyl alcohol, guar gum, (cationic or non-ionic) polydiallyl dimethyl ammonium chloride, polyacrylamide, polyethylene glycol 8000 (e.g., PEG 8000), and Jaguar 8000™ (Guar Gum 2-hydroxypropyl ether). A cationic polymer is preferred over a non-ionic polymer; and anionic polymers generally do not work well. The fatty alcohol 1-dodecanol serves to increase the surface viscosity of the foam lamellae to also increase foam stability against drainage and bubble collapse. Other foaming agents may also be included in the high-foaming formulations, namely Celquat SD 240c (at about 0.15%) and/or Lumulse POE 12 (at about 4%). Some examples of solvents are diethylene glycol monobutyl ether or isobutanol.

A different embodiment of a DF-200ME decontamination formulation, according to the present invention, can comprise a mixture of:

a) about 2% benzalkonium chloride;
b) about 2% propylene glycol diacetate or glycerol diacetate;
c) about 2-5% hydrogen peroxide;
d) about 5% potassium bicarbonate;
e) a mold remediation enhancer comprising Fe or Mn; wherein the concentration of $Fe^{2+}$ or $Mn^{2+}$ ions in the mixture is in the range of about 0.0001% to about 0.001%; and
f) a sufficient amount of potassium hydroxide to adjust the pH value of the mixture to between about 9.6 and 9.9; and
g) water (balance).

Production batches of DF-200 typically contain three liquid parts: 1) a solubilizing portion (referred to as the Penetrator by Envirofoam), 2) an ~8% hydrogen peroxide solution (referred to as the Fortifier by Envirofoam), and 3) a water-soluble peroxide activator (referred to as the Booster by Envirofoam). Contact of the iron additive with the hydrogen peroxide in DF-200 should be avoided until the formulation has been mixed and is ready to use, because hydrogen peroxide is degraded in the presence of metals. Hence, it is preferable to add the iron to the solubilizing portion (Penetrator) of the formulation.

DF-200ME decontamination formulations of the present invention can optionally be provided in kit form, where the water is added just prior to use. In one embodiment, a kit can comprise three parts:

a) a first part comprising a cationic surfactant and a mold remediation enhancer comprising Fe or Mn;
b) a second part comprising hydrogen peroxide; and
c) a third part comprising a water-soluble bleaching activator.

An "activated" decontamination formulation is formed when the three parts are mixed with water; and can be used within about 8 hours, typically. The concentration of $Fe^{2+}$ or $Mn^{2+}$ ions in the activated formulation is in the range of about 0.0001% to about 0.001%, and preferably is about 0.0007%. In some kits, the cationic surfactant can comprise benzalkonium chloride; the second part can comprise an aqueous solution of hydrogen peroxide at concentration of about 8%, and the water-soluble bleaching activator can comprise propylene glycol diacetate or glycerol diacetate. Alternatively, the second part can comprise solid urea hydrogen peroxide powder.

Optionally, propylene glycol can be added as a freeze-point depressant. Propylene glycol is considered to be an environmentally friendly antifreeze.

Optionally, a corrosion inhibitor can be added to DF-200ME formulations to reduce their corrosivity. A preferred corrosion inhibitor for is N,N-dimethyl ethanolamine. However, other corrosion inhibitors, such as triethanolamine, ethanolamine salts of C9, C10, and C12 diacid mixtures, dicyclohexyl amine nitrite, and N,N-dibenzylamine, can be used.

Optionally, glycerol can be added to DF-200ME formulations as a viscosity builder, and can be used in place of Jaguar 8000, poly (ethylene oxide), or polyethylene glycol. Glycerol is a common ingredient in cosmetics, where it is used a viscosity builder, as well as a solvent, humectant and emollient.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An aqueous decontamination formulation comprising a mixture of:

a solubilizing agent comprising a cationic surfactant;

a reactive compound comprising hydrogen peroxide;

a carbonate or bicarbonate salt;

a water-soluble bleaching activator comprising propylene glycol diacetate or glycerol diacetate;

a mold remediation enhancer comprising Mn; wherein the concentration of $Mn^{2+}$ ions in the mixture is in the range of about 0.0001% to about 0.001%; and water (balance).

2. An aqueous decontamination formulation comprising a mixture of:

about 2% benzalkonium chloride;

about 2% propylene glycol diacetate or glycerol diacetate;

about 2-5% hydrogen peroxide;

about 5% potassium bicarbonate;

a mold remediation enhancer comprising Fe or Mn; wherein the concentration of $Fe^{2+}$ or $Mn^{2+}$ ions in the mixture is in the range of about 0.0001% to about 0.001%; and a sufficient amount of potassium hydroxide to adjust the pH value of the mixture to between about 9.6 and 9.9; and water (balance).

3. The formulation of claim 1, wherein the mold remediation enhancer comprises a manganese compound selected from the group consisting of MnO, $MnCl_2$, $Mn(OH)_2$, $MnCO_3$, $Mn_3O_4$, MnS, $MnSO_4$, $Mn(CH_3COO)_2$, hydrated forms of these compounds, and combinations thereof.

4. The formulation of claim 1, wherein the cationic surfactant comprises benzalkonium chloride at a concentration less than about 10% of the mixture.

5. The formulation of claim 1, wherein the cationic surfactant comprises a mixture of benzyl (C12-C16) alkyldimethylammonium chlorides.

6. The formulation of claim 1, wherein the carbonate or bicarbonate salt comprises potassium bicarbonate.

7. The formulation of claim 1, further comprising a sufficient amount of potassium hydroxide to adjust the pH value of the mixture to between about 9.6 and 9.9.

8. The formulation of claim 1, further comprising a cationic hydrotrope.

9. The formulation of claim 8, wherein the cationic hydrotrope comprises pentamethyltallow alkyltrimethylenediammonium dichloride.

10. The formulation of claim 8, further comprising a fatty alcohol, a water-soluble polymer, and a solvent.

11. The formulation of claim 10, wherein the fatty alcohol comprises 1-dodecanol; the water-soluble polymer comprises polyethylene glycol, and the solvent comprises diethylene glycol monobutyl ether or isobutanol.

12. The formulation of claim 2, wherein the mold remediation enhancer comprises an iron compound selected from the group consisting of $FeCl_2$, $Fe(OH)_2$, $FeCO_3$, $Fe_2O_4$, FeS, $FeS_2$, $FeSO_4$, $FePO_4$, $FeF_3$, $Fe(NO_3)_3$, hydrated forms of these compounds, and combinations thereof.

13. The formulation of claim 12, wherein the mold remediation enhancer comprises $FeCl_2.4H_2O$; and wherein the concentration of $Fe^{2+}$ in the mixture is about 0.0007%.

* * * * *